US006663083B1

(12) United States Patent
Smith

(10) Patent No.: US 6,663,083 B1
(45) Date of Patent: Dec. 16, 2003

(54) CROWBAR WITH PIVOT ARM

(76) Inventor: Virgil Smith, 66 Riviera La., Poplar Bluff, MO (US) 63901

( * ) Notice: Subject to any disclaimer, the term of this patent is extended or adjusted under 35 U.S.C. 154(b) by 0 days.

(21) Appl. No.: 10/345,740

(22) Filed: Jan. 16, 2003

(51) Int. Cl.[7] ..... B25C 11/00
(52) U.S. Cl. ..... 254/25; 254/131; 254/30
(58) Field of Search ..... 254/25, 17, 131, 254/131.5, 28, 18, 30

(56) References Cited

U.S. PATENT DOCUMENTS

| | | | | | |
|---|---|---|---|---|---|
| 178,407 | A | | 6/1876 | Butts | |
| 977,986 | A | | 12/1910 | Waddell | |
| 1,309,734 | A | | 7/1919 | Hemfling, Sr. | |
| 1,570,192 | A | * | 1/1926 | Younick | 254/131 |
| 2,087,148 | A | | 7/1937 | Hempy | |
| 2,457,231 | A | | 12/1948 | Henderson | |
| 2,525,226 | A | | 10/1950 | Lawellin | |
| 2,693,935 | A | | 11/1954 | Halbert | |
| D199,019 | S | * | 8/1964 | Marson | D93/4 |
| 3,522,932 | A | * | 8/1970 | Nakasone | 254/131 |
| 3,744,758 | A | | 7/1973 | Nakasone | |
| 4,183,503 | A | * | 1/1980 | Ward | 254/131 |
| 4,380,326 | A | | 4/1983 | Marzorati et al. | |
| 5,547,168 | A | | 8/1996 | Kelly | |
| 5,855,358 | A | | 1/1999 | Witter | |
| 6,186,479 | B1 | | 2/2001 | Witter | |

* cited by examiner

*Primary Examiner*—Lee D. Wilson
(74) *Attorney, Agent, or Firm*—Polster, Lieder, Woodruff & Lucchesi, L.C.

(57) ABSTRACT

A crowbar of the present invention includes a shaft, a curved neck at one end of the shaft, a straight section extending from the end of the curved neck, and a pivot arm positioned substantially at the junction between the curved neck and the straight section. The pivot arm is positioned above the straight section and preferably forms an angle of about 90° with the straight section. Additionally, the pivot arm is relatively short, having a length of less than 4". Preferably, the pivot arm has a length of about 2" to about 4". Additionally, although the crowbar could be supplied with a single pivot arm, it is preferably supplied with two pivot arms extending in opposite directions from each other.

5 Claims, 2 Drawing Sheets

CROWBAR WITH PIVOT ARM

CROSS-REFERENCE TO RELATED APPLICATIONS

This application is based on Disclosure Document No. 516157 which was received in the Patent Office on Aug. 8, 2002.

STATEMENT REGARDING FEDERALLY SPONSORED RESEARCH OR DEVELOPMENT

Not Applicable.

BACKGROUND OF THE INVENTION

This invention relates to crowbars or pry bars, and, in particular, to a crowbar which can be used to more easily separate two pieces of wood without marring the wood.

Crowbars and pry bars have long been used to separate pieces of wood or other items which are connected (i.e., nailed) together. Often during construction, for example, of a house or other building, it is necessary to separate two cross-bars which have been connected together. When a traditional crowbar is used, the head or claw of the crowbar is forced between the two pieces of wood, and the top piece of wood is pried off the bottom piece of wood. While this works to separate the two pieces of wood, the act of forcing the claw between the two pieces of wood can mar or splinter one or both pieces of wood, making either or both pieces of wood unusable. As can be appreciated, this results is waste.

Crowbars have been designed to help tear up floors. For example, Waddell, Pat. No. 977,986 discloses a crowbar having arms extending out from opposite sides of the crowbar's claw which act as a fulcrum to provide for extra stabilization of the crowbar during use. The bottom of the arms are level with the bottom of the claw. Hence, the claw will be difficult to properly position to separate two cross-beams. Further, the position of the arms changes the direction of force which is applied to the claw (and hence to the boards being separated) making it difficult to pry apart cross-beams, unless the claw is forced between the two cross-beams. Such use of the crowbar, as noted above, can lead to marring and splintering of the beams being separated.

BRIEF SUMMARY OF THE INVENTION

Briefly stated, a crowbar of the present invention includes a shaft, a curved neck at one end of the shaft, a straight section extending from the end of the curved neck, and a pivot arm positioned substantially at the junction between the curved neck and the straight section. The pivot arm is positioned above the straight section and preferably forms an angle of about 90° with said straight section. Additionally, the pivot arm is relatively short, having a length of less than 4". Preferably, the pivot arm has a length of about 2" to about 4". Additionally, although the crowbar could be supplied with a single pivot arm, it is preferably supplied with two pivot arms extending in opposite directions from each other.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
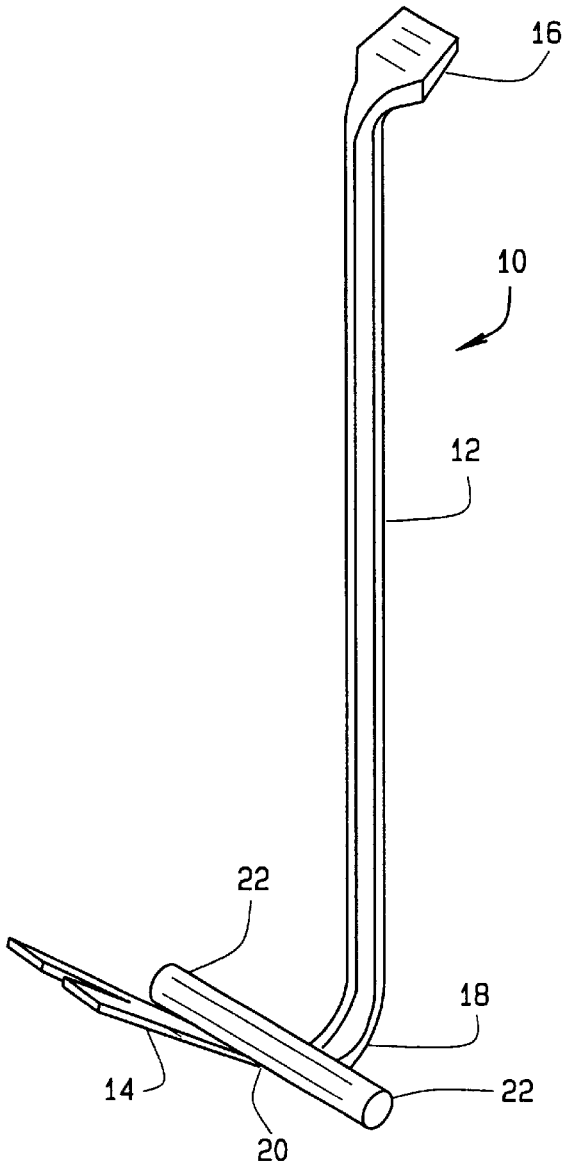
FIG. 1 is a perspective view of a crowbar of the present invention.
Figure 2:
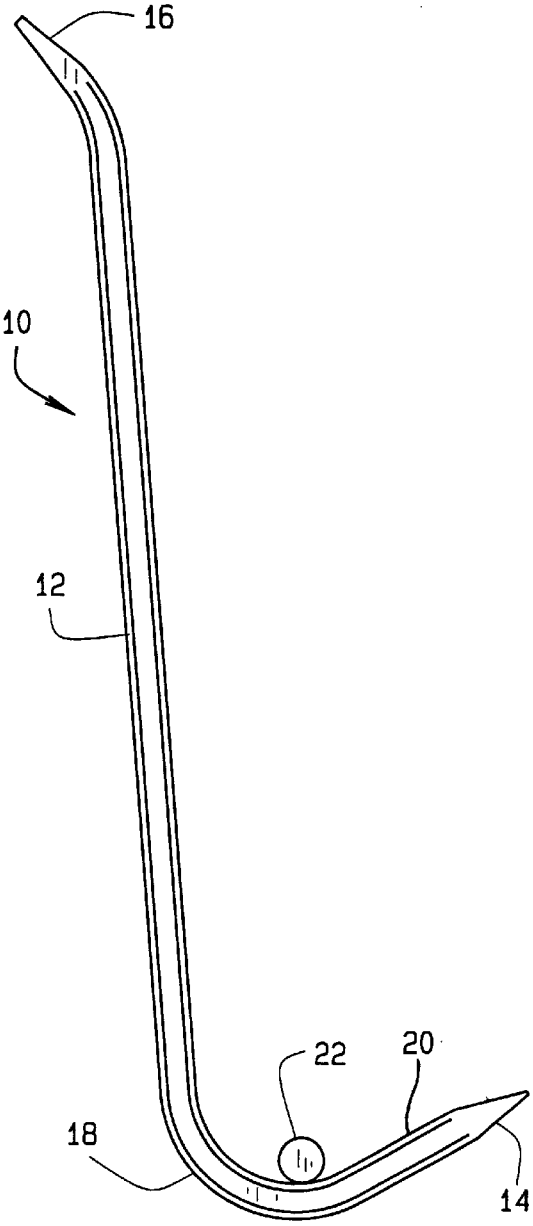
FIG. 2 is a side elevational view of the crowbar.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

A crowbar 10 of the present invention is shown generally if FIG. 1. The crowbar 10 includes a shaft 12 with a claws 14 and 16 at opposite ends of the shaft 12. The claws 14 and 16 are both tapered with flat upper and lower surfaces to facilitate use of the claws in prying apart two members. The claw 16 extends from the shaft 12 at a slight angle with respect to the shaft. The claw 14, however, is connected to the shaft 12 by means of a curved neck 18. As can be seen in FIG. 1, the neck curves around, and then the claw 14 is formed at the end of a straight portion 20 which extends from the end of the curved neck 18. Thus, straight portion 20 defines an acute angle with the shaft 12.

To facilitate use of the crowbar is separating two cross-beams without splintering or substantially marring the cross-beams, the crowbar 10 is provided with pivot arms 22 which extend out from opposite sides of the crow-bar at the base of the straight portion 20 (i.e., at the junction of the straight portion 20 and the neck 18). Preferably, the pivot arms form an angle of about 90° with the straight portion 20. The pivot arms are positioned on the top surface of the straight portion 20. Hence, the arms 22 do not lie in the same plane as the straight portion 20. The pivot arms 22 can be formed integrally with the crowbar 10, or can be welded to the crowbar. The pivot arms are preferably fairly short, and preferably extend only about 2" to 4" from straight portion 20 in either direction.

Figure 3:
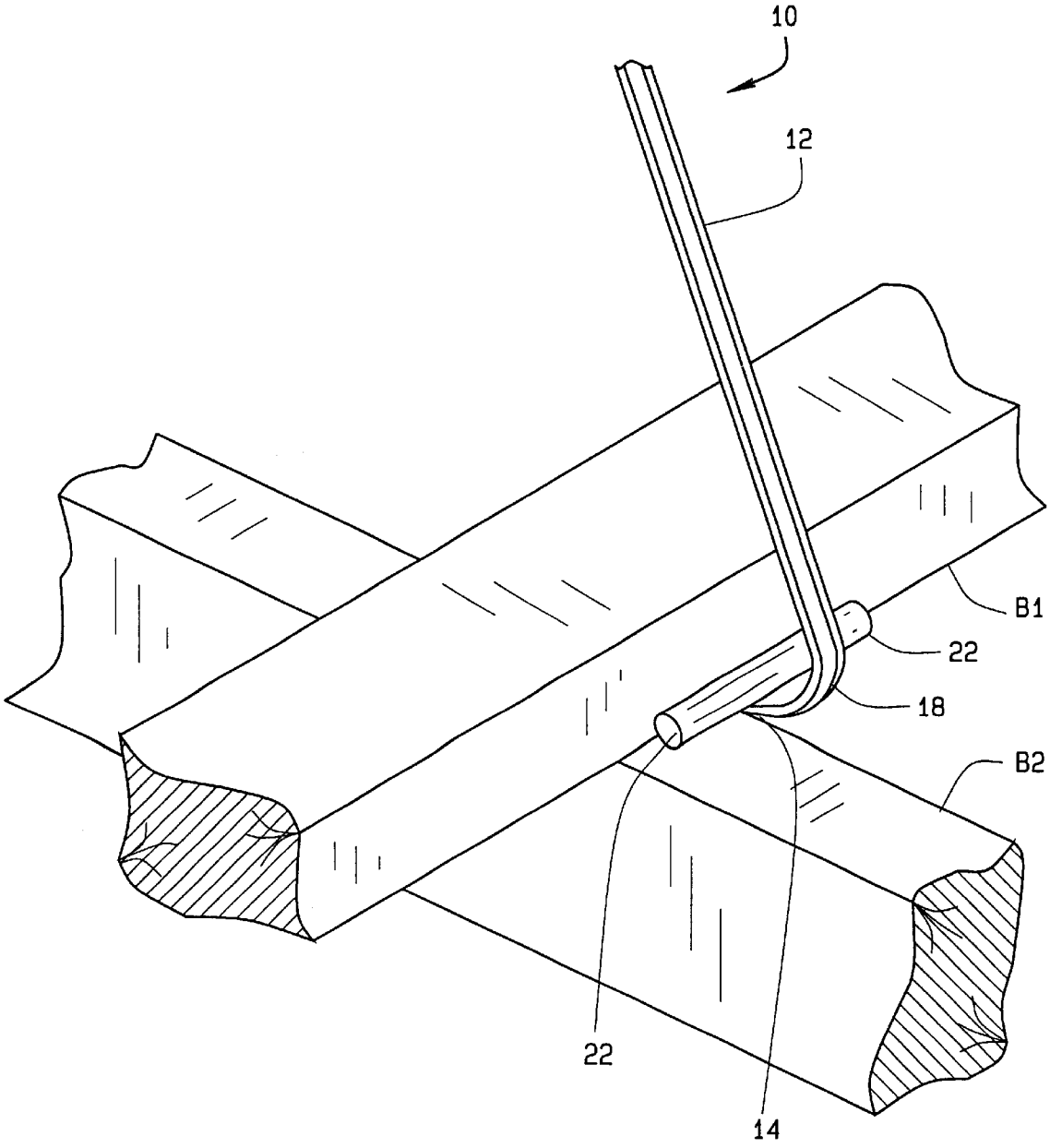
FIG. 3 is a perspective view showing the crowbar in use.

The use of the crowbar 10 to separate two cross-beams B1 and B2 is shown in FIG. 3. As can be seen, the pivot arm 22 is positioned on the lower cross-beam B2 with the straight portion 20 and the claw 14 under the upper cross-beam B1, with the claw and straight portion 20 adjacent the lower crossbeam. The shaft 12 can the be pressed downwardly to pry the upper beam B1 off the lower beam B2. When the shaft 12 is pressed downwardly, it will pivot about the arm 22 positioned at the junction of the beams B1 and B2, as seen in FIG. 3. As can be appreciated, if a conventional crowbar were used, the claw would have to be forced between the two beams. When the claw is forced between the two beams, only a small portion of the claw initially is urged between the two beams. Hence, during the initial effort to pry the two beams apart, a substantial amount of force is applied to a small area of the beam. The crowbar 10 on the other hand, allows for the entire straight section 20 to be placed beneath the upper beam B1. Thus, there is no need to force the claw 14 between the two beams. Further, because the entire straight section 20 is under the upper beam B1, the lifting force applied to the beam B1 will be applied over a substantial width of the beam B1, rather than only over a short portion of the beam. Because the lifting force is applied over a much greater width of the of the beam when the crowbar 10 is used, the possibility of damage to either the upper or lower beams is substantially reduced.

The length of the arms 22 is also important to the operability of the crowbar 10. Because the arms 22 are relatively short (i.e., 2"–4"), when the shaft is pressed down, the line of force will be substantially straight. Stated differently, because the arms 22 are relatively short, substantially no torquing will occur during use of the crowbar.

As various changes could be made in the above constructions without departing from the scope of the invention, it is intended that all matter contained in the above description or shown in the accompanying drawings shall be interpreted as illustrative and not in a limiting sense. For example, the crowbar 10 could be provided with only one arm 22. The use of two arms 22 is preferred because the crowbar is then more versatile. Additionally, because the crowbar 10 does not require that the claw be forced between the two boards, the claw could be removed. These variations are illustrative only.

What is claimed is:

1. A crowbar having a shaft, a curved neck at one end of the shaft, a straight section extending from the end of the curved neck, and a pivot arm positioned substantially at the junction between the curved neck and the straight section, said pivot arm serving as an off-center pivot for the crow bar; said curved neck having an inner surface and an outer surface and said straight section having an upper surface and a lower surface; said straight section upper surface being a continuation of said neck inner surface and said straight portion lower surface being a continuation of said neck outer surface; said pivot arm having an upper surface and a lower surface; said pivot arm being mounted to said straight section such that said pivot arm lower surface is above said straight portion upper surface and that the pivot arm lies in a plane above the plane in which the straight portion lies.

2. The crowbar of claim 1 wherein said pivot arm forms an angle of about 90° with said straight section.

3. The crowbar of claim 1 wherein said pivot arm has a length of less than 4".

4. The crowbar of claim 3 wherein said pivot arm has a length of about 2" to about 4".

5. The crowbar of claim 1 wherein said crowbar includes two pivot arms, said pivot arms being co-linear with each other.

* * * * *